US009756415B2

(12) United States Patent
Solomon et al.

(10) Patent No.: US 9,756,415 B2
(45) Date of Patent: Sep. 5, 2017

(54) HEADPHONES WITH A FOAM MATERIAL BODY

(71) Applicant: Hsu-Sheng Yu, Tainan (TW)

(72) Inventors: Peter Solomon, Dania Beach, FL (US); Christopher Piedra, Dania Beach, FL (US); Juan Galindo, Dania Beach, FL (US); Edward Martin, Dania Beach, FL (US)

(73) Assignee: Hsu-Sheng Yu, Tainan (TW)

( * ) Notice: Subject to any disclaimer, the term of this patent is extended or adjusted under 35 U.S.C. 154(b) by 0 days.

(21) Appl. No.: 14/931,391

(22) Filed: Nov. 3, 2015

(65) Prior Publication Data

US 2017/0134842 A1 May 11, 2017

Related U.S. Application Data

(63) Continuation of application No. 14/547,679, filed on Nov. 19, 2014, now Pat. No. 9,185,483.

(60) Provisional application No. 61/906,130, filed on Nov. 19, 2013.

(51) Int. Cl.
*H04R 1/10* (2006.01)

(52) U.S. Cl.
CPC ..... *H04R 1/105* (2013.01); *H04R 1/1008* (2013.01); *H04R 1/1066* (2013.01); *H04R 1/1075* (2013.01)

(58) Field of Classification Search
CPC .... H04R 1/10; H04R 2205/022; H04R 1/105; H04R 5/0335; H04R 2201/10
USPC ..... 381/370, 377–378
See application file for complete search history.

(56) References Cited

U.S. PATENT DOCUMENTS

| | | | | |
|---|---|---|---|---|
| 5,018,599 | A | 5/1991 | Dohi et al. | |
| 5,590,213 | A | 12/1996 | Urella et al. | |
| 5,706,345 | A | 1/1998 | Allen | |
| 6,295,366 | B1 | 9/2001 | Haller et al. | |
| 6,333,982 | B1 | 12/2001 | Sapiejewski et al. | |
| 6,603,863 | B1 * | 8/2003 | Nagayoshi | H04R 5/0335 381/378 |
| 7,245,736 | B2 | 7/2007 | Tsunoda et al. | |
| 7,717,226 | B2 | 5/2010 | Purcell et al. | |
| 7,885,419 | B2 | 2/2011 | Wahl et al. | |
| 8,737,668 | B1 | 5/2014 | Blair et al. | |
| 9,185,483 | B2 * | 11/2015 | Solomon | H04R 1/1091 |
| 2002/0085733 | A1 * | 7/2002 | Cottrell | H04R 5/033 381/371 |
| 2003/0059071 | A1 | 3/2003 | Dunham | |
| 2008/0205683 | A1 * | 8/2008 | Weyer | H04R 1/1066 381/381 |

FOREIGN PATENT DOCUMENTS

WO 2008123667 A1 10/2008

* cited by examiner

*Primary Examiner* — Suhan Ni
(74) *Attorney, Agent, or Firm* — Laurence A. Greenberg; Werner H. Stemer; Ralph E. Locher

(57) ABSTRACT

A mono-body set of headphones made from a foam material and having a fixed length of headband between ear pads is provided. The mono-body headphones are, preferably, flexible and durable, permitting the headphones to be straightened, twisted or bent without breaking.

8 Claims, 6 Drawing Sheets

HEADPHONES WITH A FOAM MATERIAL BODY

CROSS-REFERENCE TO RELATED APPLICATIONS

The present application is a continuation of U.S. patent application Ser. No. 14/547,679, filed Nov. 19, 2014 and issuing on Nov. 10, 2015 as U.S. Pat. No. 9,185,483, which application claimed the benefit of Provisional Patent Application No. 61/906,130, filed on Nov. 19, 2013; those applications being incorporated herein, by reference, in their entireties.

BACKGROUND OF THE INVENTION

Field of the Invention

The present invention relates to mono-body, flexible headphones and, more particularly flexible headphones having a single piece, fixed length body made from a foam material.

Description of the Related Art

In the art, headphones are provided that include a headband disposed between two ear pads. Stereo speaker headphones include speakers in the ear pads, while noise reducing headphones may not. Conventional headphones typically include an adjustment mechanism that allows the distance between the ear pads to be adjusted for a better fit personalized to the user, usually by allowing the headband portion between the ear pads to be lengthened or shortened. This permits the ear pads to be moveable relative to the headband, so that the ear pads can be adjusted into alignment with the ears of each particular user. However, such adjustment mechanisms can experience wear and tear that can result in damage to the headphones.

What is needed are headphones that are flexible, yet durable. What is further needed are mono-body headphones wherein the fit can be adjusted by means other than physically lengthening or shortening the headband portion (i.e., the distance) between the ear pads.

SUMMARY OF THE INVENTION

The present invention satisfies the needs set forth above and, in particular, provides a set of headphones having a flexible body that is durable and made of a foam material. In one particular embodiment of the invention, the positions of the ear pads are fixed relative to the position of the headband, and the headband is not adjustable to lengthen or shorten the headband between the ear pads. Rather, in that particular embodiment, a pad is provided that can be mated with, or removed from, the headband of the headphones, thus raising or lowering the headband relative to the top of the user's head, in order to change the position of the ear pads relative to the user's ears. In other embodiments, a pad need not be provided.

Other features, which are considered as characteristic for the invention, are set forth in the drawings and the appended claims.

Although the invention is illustrated and described herein as embodied in headphones with a foam material body, it is nevertheless not intended to be limited to the details shown, since various modifications and structural changes may be made therein without departing from the spirit of the invention and within the scope and range of equivalents of the claims.

The construction of the invention, together with additional objects and advantages thereof, will be best understood from the following description of the specific embodiment when read in connection with the accompanying drawings.

BRIEF DESCRIPTION OF THE DRAWINGS

For a fuller understanding of the nature of the present invention reference should be made to the following detailed description taken in connection with the accompanying drawings in which.

DETAILED DESCRIPTION OF THE PREFERRED EMBODIMENT

Figure 1A:
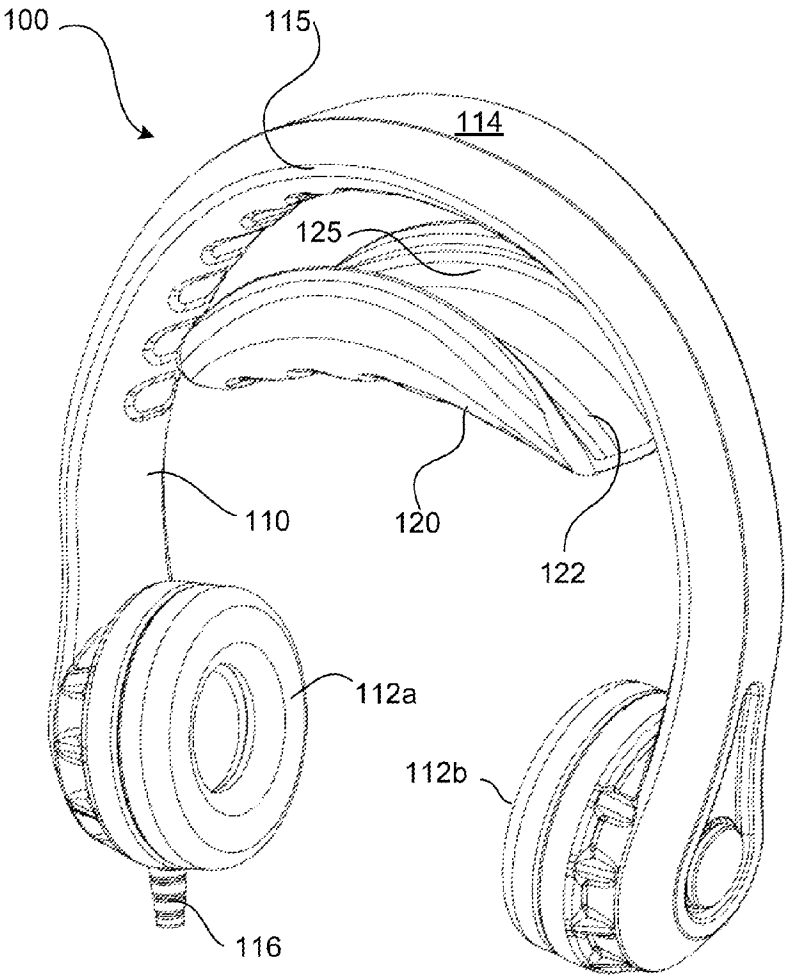
FIG. 1A is an exploded view of the headphones and removable headband pad of FIG. 1.
Figure 1:
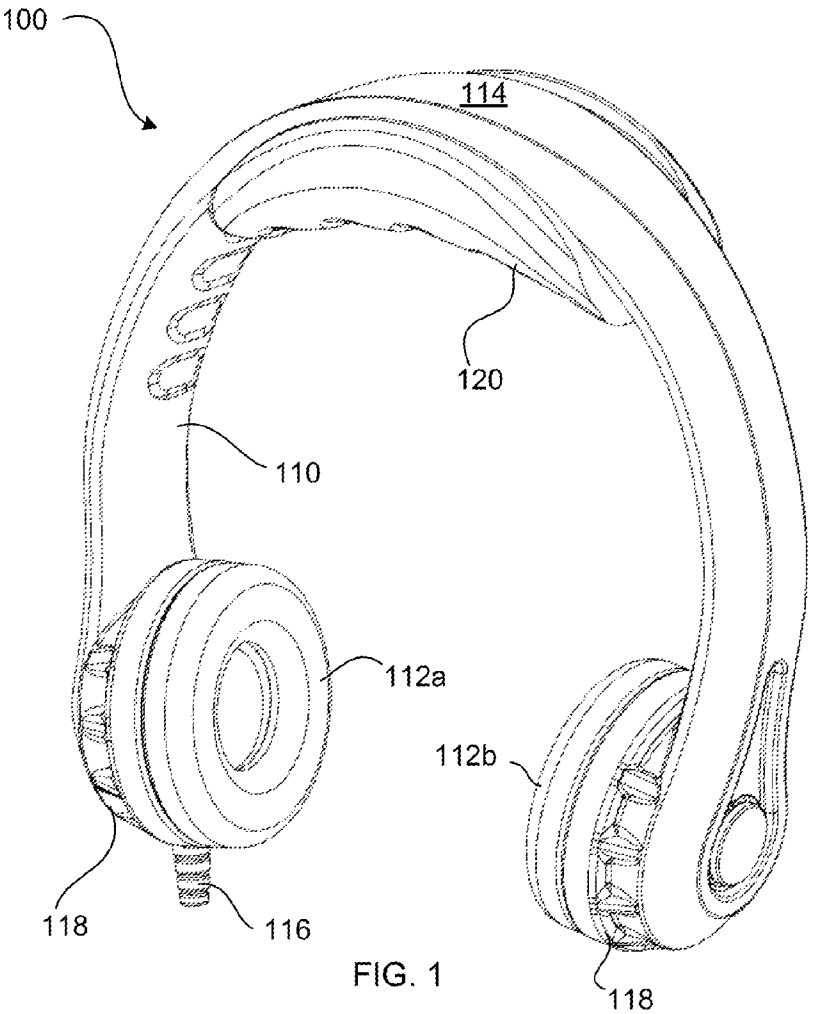
FIG. 1 is a perspective view of a set of headphones including a removable headband pad in accordance with one particular embodiment of the invention.
Figure 2:
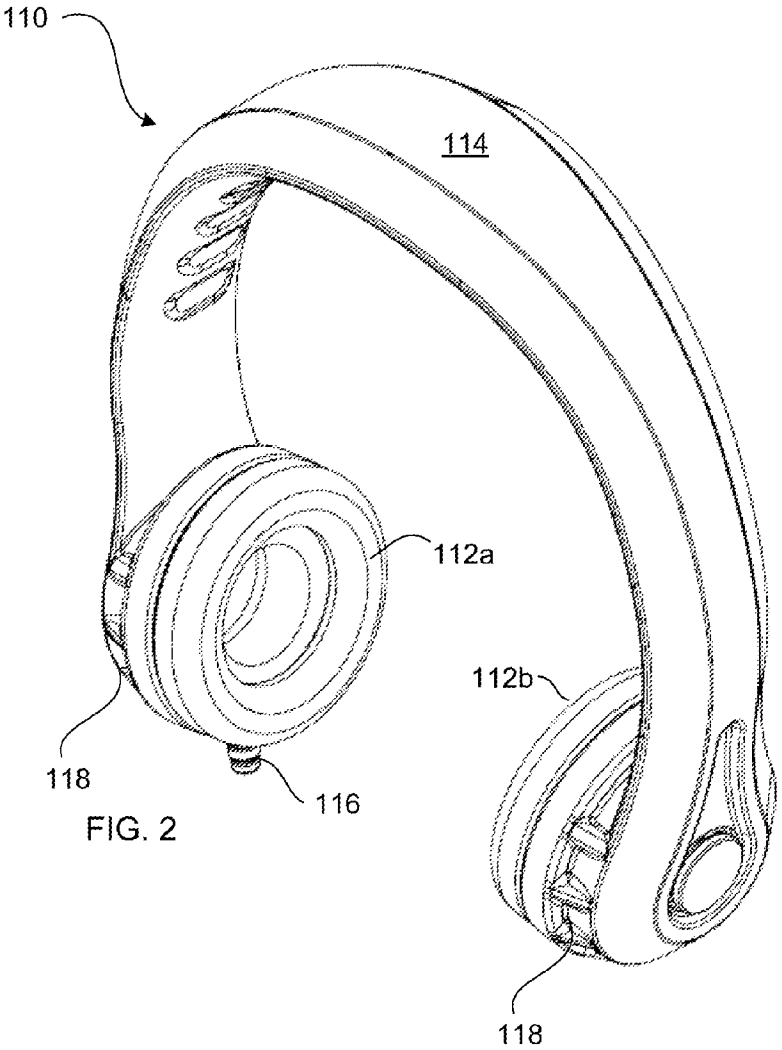
FIG. 2 is a perspective view of a set of headphones in accordance with one particular embodiment of the present invention.
Figure 1B:
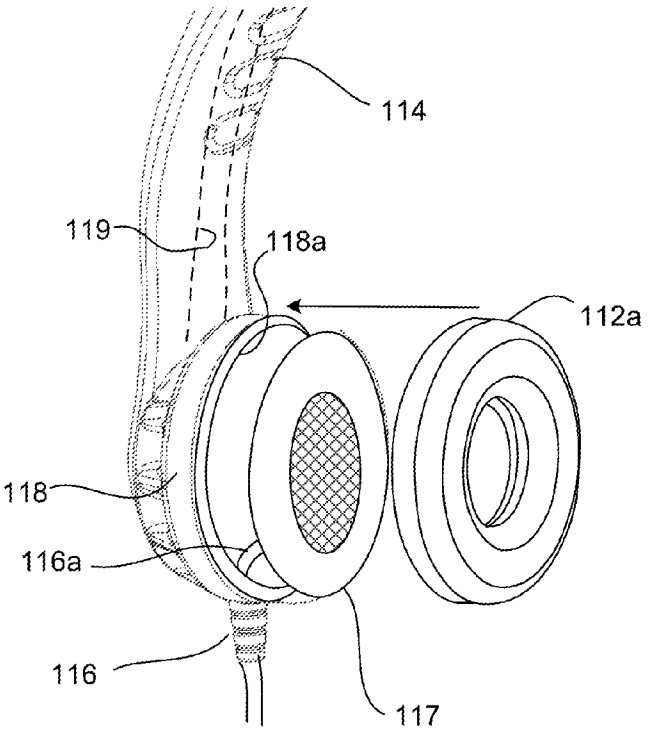
FIG. 1B is an exploded view of a portion of the headphones of FIG. 1.
Figure 3:
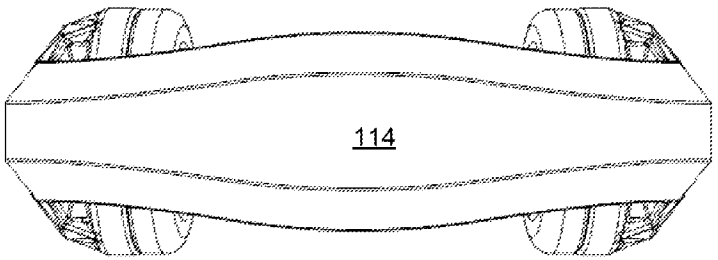
FIG. 3 is a top plan view of a set of headphones in accordance with one particular embodiment of the invention.
Figure 4:
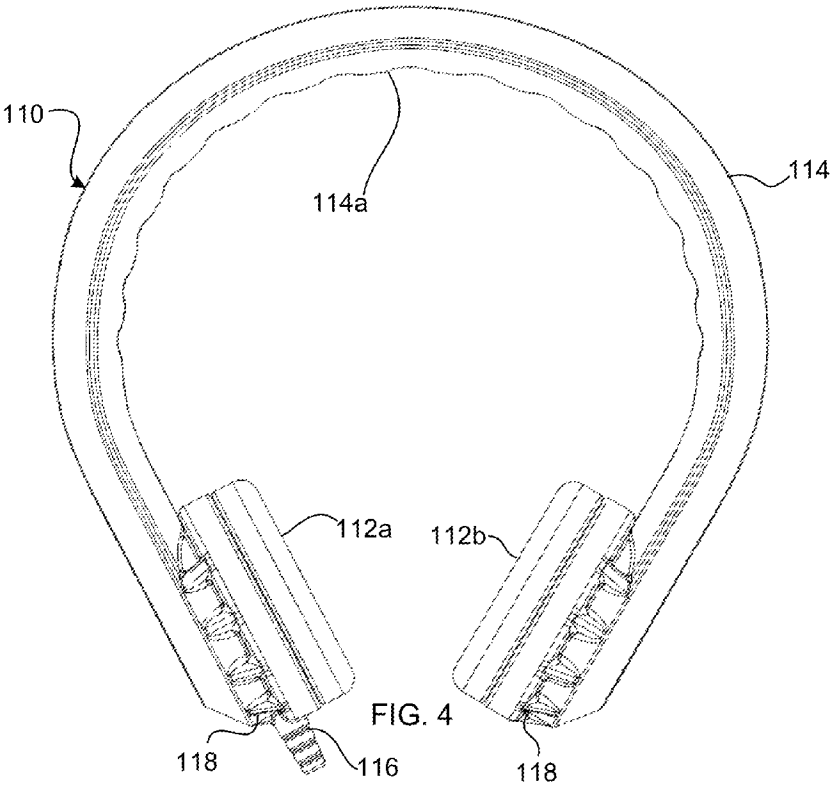
FIG. 4 is a front plan view of a set of headphones in accordance with one particular embodiment of the invention.
Figure 5:
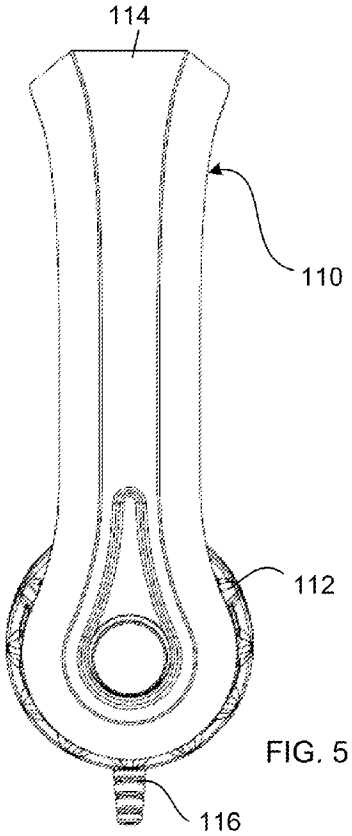
FIG. 5 is a side plan view of a set of headphones in accordance with one particular embodiment of the present invention.
Figure 6B:
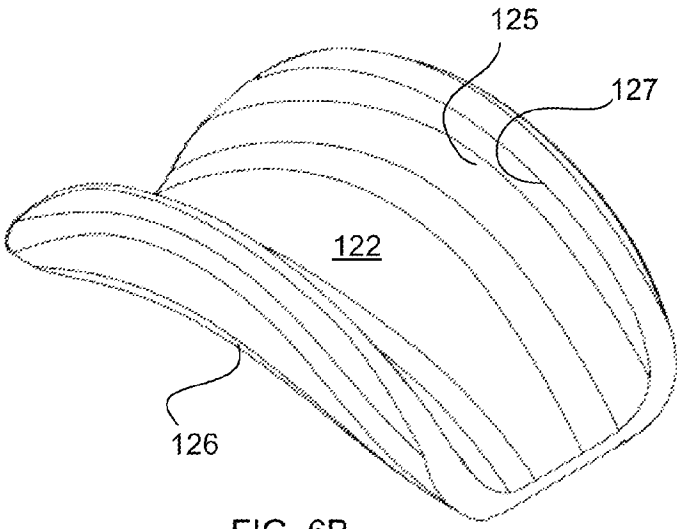
FIGS. 6A-6D are, respectively, top plan, perspective, side plan and front plan views of a removable headband pad in accordance with one particular embodiment of the present invention.
Figure 6D:
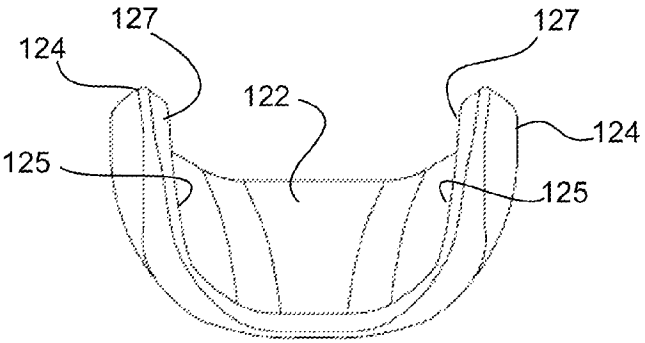
Figure 6A:
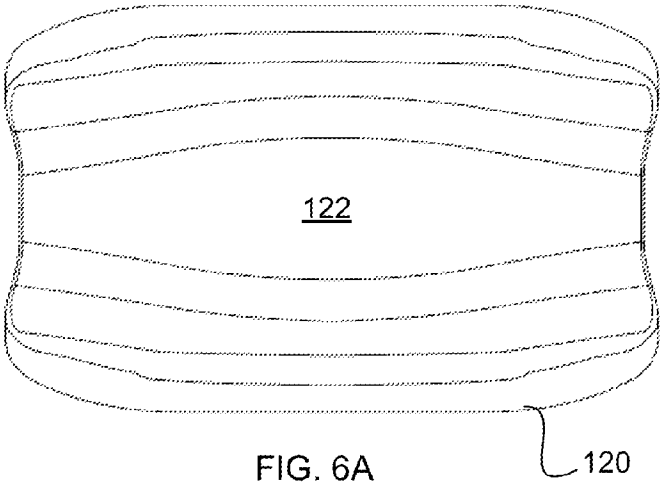
Figure 6C:
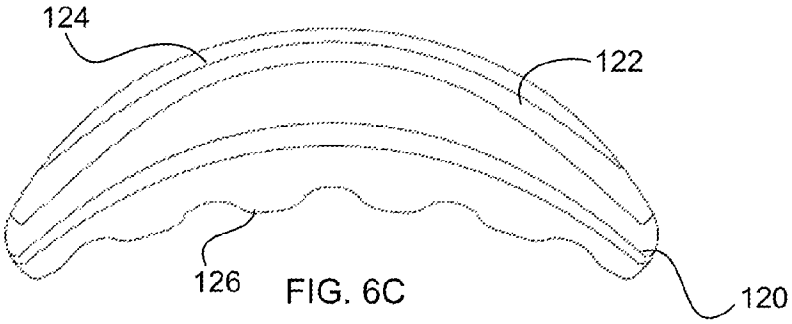
Figure 7B:
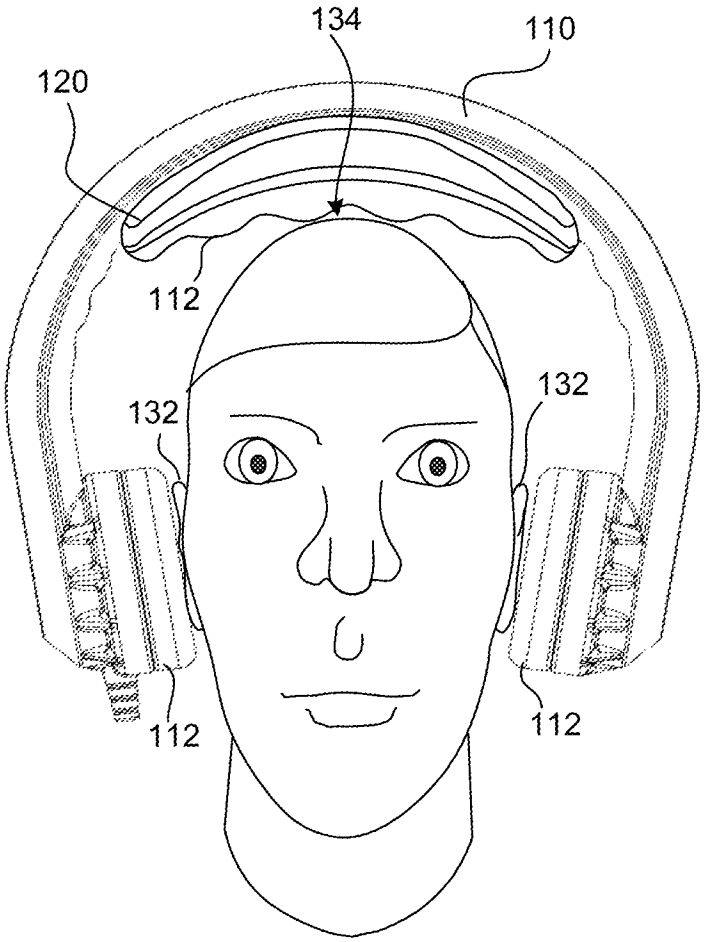
FIGS. 7A and 7B are illustrations helpful in understanding the headphones and removable pad system of one particular embodiment of the present invention.
Figure 7A:
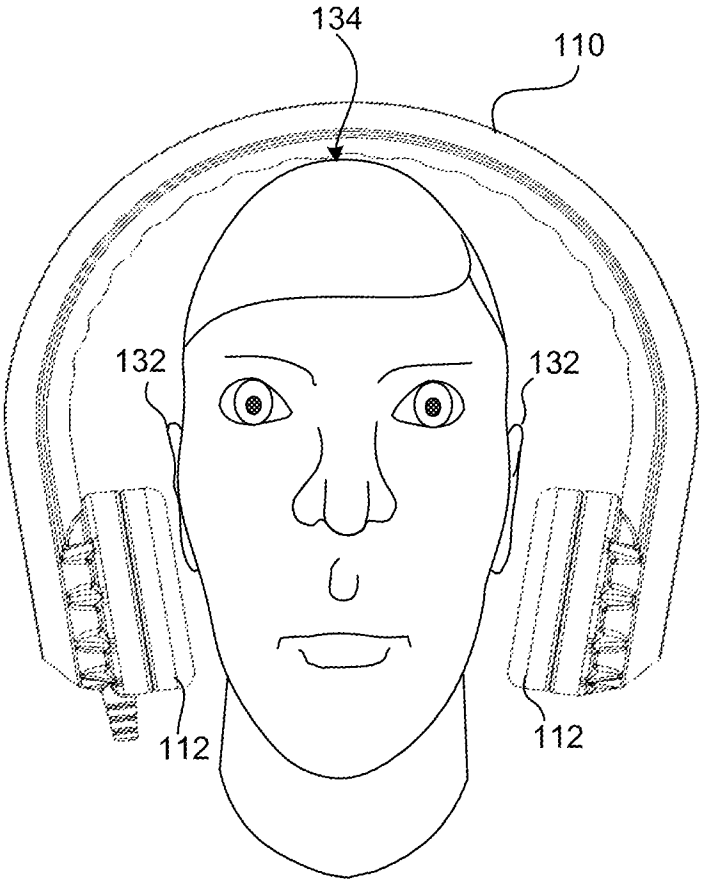

Referring now to FIGS. 1-8B, a headphones system 100 is provided. The headphones system 100 includes headphones 110 and a removable/insertable headband pad 120.

As with conventional headphones, the headphones 110 include a headband 114 having right and left ear pads 112*a*, 112*b*, which ear pads are designed to press against the ears 132 of a user. However, conventional headphones typically include a mechanism by which the effective length of the headband can be adjusted to change the distance between the ear pads and, thus, to change the position of the ear pads 112 relative to the user's ears 132. One example of such a mechanism is shown in U.S. Pat. No. 8,565,468, incorporated herein by reference. This is not the case with the headphones 110 of the present invention.

Unlike conventional headphones, the headphones 110 do not include a mechanism that permits movement of the ear pads 112*a*, 112*b* relative to the headband 114. Rather, the headphones 110 are formed having a flexible, mono-body construction wherein each ear pad 112*a*, 112*b* is immovably fixed to the headband 114. More particularly, the ear pad or speaker housings 118 that receive the headphone speakers 117 are integrally formed as a single piece with the headband 114. Ear pads 112 are adhered over an open cavity 118*a* formed in the housings 118, after the headphone speakers and wires have been mounted into the single-piece body. As the headband 114 and ear pad housings 118 are formed together as a single-body (i.e., mono-body) construction, the positions of the ear pads 112*a*, 112*b* relative to the headband 114, as well as the ear pad positions relative to one another, cannot be changed. For purposes of the present application, the term "mono-body" describes the single piece construction of the headband 114 and the housings 118, which are formed as a single, integrated piece. In one particular embodiment of the invention, the mono-body (integral headband 114 and housings 118) are formed using injection molding.

More particularly, the mono-body construction of the headphones 110 means that the headband 114 of the present invention does not include a slide mechanism or any other mechanism for changing the positions of the ear pads 112 along the headband 114. Rather, in the present preferred embodiment of the invention, the positions of the housings 118, and, thus, the positions of the ear pads 112*a*, 112*b* (affixed to the housings 118 over the inserted speakers 117), are permanently fixed along the headband 114.

As a consequence, the distance between the ear pads 112 cannot be changed to adjust the fit of the headphones 110 relative to the ears 132 of a user. Instead, according to one particular embodiment of the present invention, at least one pad 120 is provided to engage the headband 114 and sit between the inner surface 114*a* of the headband and the top or crown 134 of the user's head. The engagement and disengagement of the pad 120 changes the level (i.e., height) of the ear pads 112 relative to the ears 132 of the user, by changing the distance between the inner surface 114*a* and the crown of the user's head. For example, referring more particularly to FIGS. 7A-7A, the position of the ear pads 112 relative to the user's ears 132 can be raised (from that shown in FIG. 7A to that of FIG. 7B), by adding the pad 120 between the headband 114 and the top 134 of the user's head. Conversely, although not shown, if the earphones are above the user's ears with the pad 120 engaged, then the pad 120 can be removed to better align the ear pads 112 with the ears 132 of the user.

Referring back to FIGS. 1-7B, the pad 120 can be engaged with the inner surface of the headband 114 by mating a groove 122 in the inner surface of the pad 120 with the curve of the inner surface 114*a* of the headband 114. In one particularly preferred embodiment of the invention, the pad 12 and headband 114 are held together by a simple friction fit or snap fit. Alternately, hook and loop fasteners, magnets or other locking mechanisms can be provided to keep the inner surface 114*a* engaged with the groove 122 of the pad. In the present preferred embodiment, the pad 120 is curved to match and mate with the inner curve of the headband 114. For example, the inner surface of the groove 122 is curved, as is the outer surface 126, which sits in contact with the top 134 of the user's head, when the pad 120 is mated with the headphones 110. Optionally, the outer surface 126 can include a plurality of ribs or channels, to permit air to flow between the headphones 110 and the crown of the user's head. The thickness of the floor of the pad between the inner surface 122 and the outer surface 126 is selected to optimize the position adjustment offered by use of the pad 120. In one particular embodiment of the invention, the maximum thickness between the surfaces 122 and 126 is 0.5 inches. Other thicknesses for the base of the pad 120 are also possible, as desired.

Additionally, in the present particular embodiment of the pad 120, curved sides 124 of the pad 120 are provided for contacting and holding the pad 120 to the sides of the headband 114. In particular, in the presently illustrated embodiment, the sides 124 hold the width of the headband 114 therebetween in a frictional engagement. Additionally, in one particular embodiment of the invention, the curved sides 124 include recesses or grooves 125 that receive a ridge 115 on either side of the headband 114, to mate the pad 120 with the headband 114. Additionally, if desired, the inner sidewalls 124 can be formed with ridges 127 disposed above the recesses 125, to maintain the ridges 115 of the headband 114 within the recesses 125 in a snap fit.

Referring back to FIGS. 1-8B, the headphones system 100 of the present invention is designed to be durable, thus eliminating any sliding parts or vulnerable parts required to move the ear pads 112 relative to the headband 114. In one particularly preferred embodiment of the invention, the headphones 110 are made from a flexible material that permits the twisting and/or bending of the mono-body (as shown, for example, in FIGS. 8A and 8B), without breaking. For example, the headphones 110 (including the headband 114 and the outer housings 118 supporting the ear pads 112) are made of a plastic or resin, and most preferably, of a closed foam plastic or resin, such as polystyrene or expanded polypropylene (EPP). In one particularly desired embodiment, the mono-body including headband 114 and housings 118 is formed from ethylene vinyl acetate (EVA) foam.

Figures 8A, 8B:
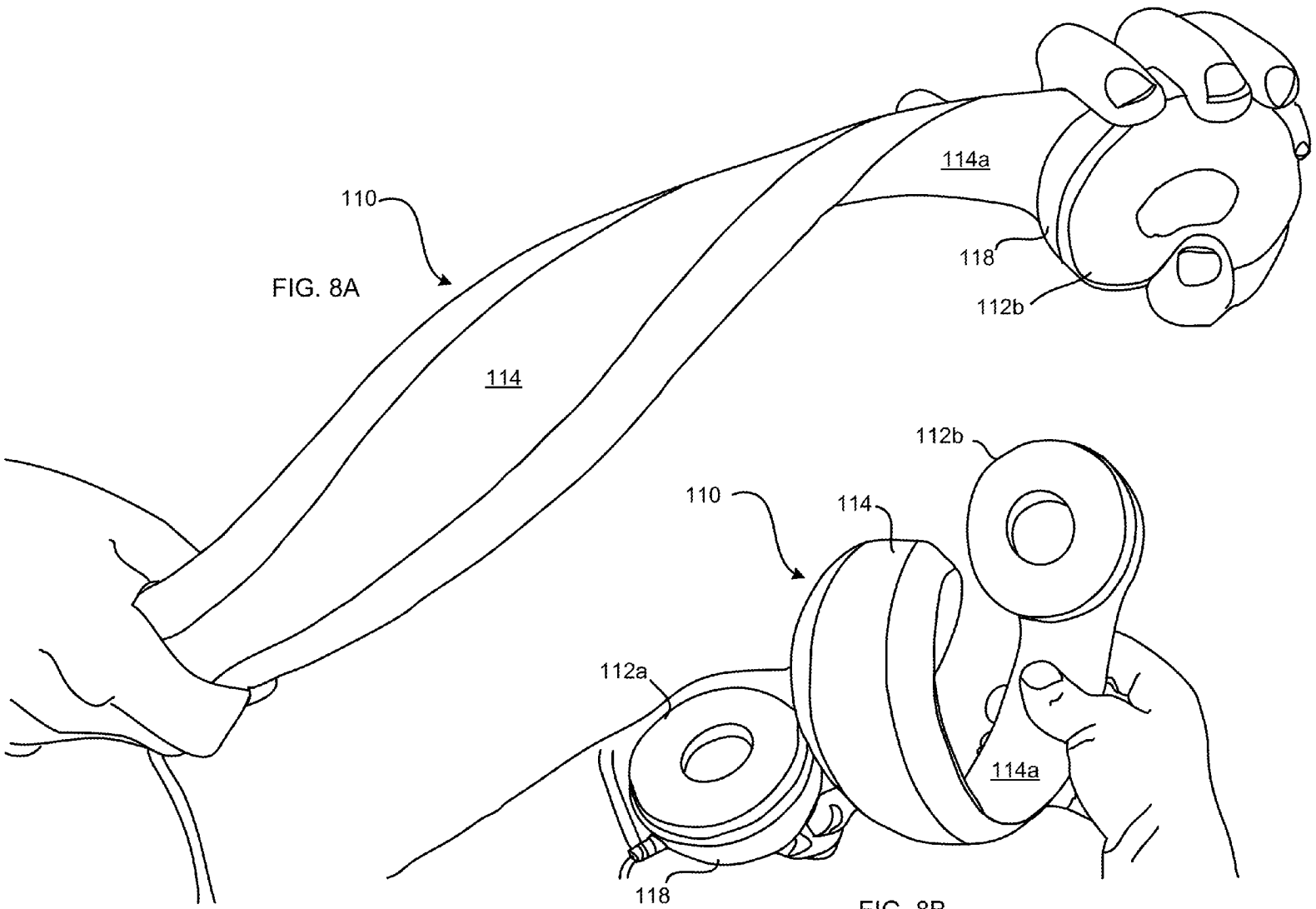
FIGS. 8A and 8B are illustrations helpful in understanding the flexibility and construction of the headphones of one particular embodiment of the present invention.

Thus, it is a desirable feature of the present embodiment of the invention that the single piece body of the headphones (i.e., headband 110 and housings 118) be selected from a material that is flexible and durable, while still maintaining their desired shape and with sufficient shape memory to return to the desired, original shape after being bent, twisted and/or stretched out by the user. For example, as shown in FIGS. 8A and 8B, the material selected for the mono-body should be sufficiently flexible to permit stretching out of the mono-body (FIG. 8A) and/or twisting of the mono-body (FIG. 8B), without breaking, and should have sufficient shape memory to return to the original shape (FIG. 4) once released.

Additionally, in order to maintain the intended distance between the inner surface of the headband 114 and the bottom surface 126 of the pad 120, the pad 120 is additionally, most preferably, made of a flexible material, such as polymer, plastic or resin, and in particular, a polystyrene material, EPP or EVA foam. It should be understood that other lightweight materials can also be used without deviating from the scope and spirit of the present invention. However, it is intended that the pad 120 not compress between the inner surface 114 and the top 134 of the head of the user. Such a compression of the pad 120 would undesirably change the position of the ear pads 112 relative to the ears 132 and, thus, using a compressible material (such as a compressible or spongy foam) would be undesirable. However, some flex can be provided, so that the sides 124 of the pad 120 can be bent slightly to engage with, and disengage from, the headband 114.

If desired, the system 100 of the present invention can be sold as kit including a plurality of pads 120, each having a different base thickness (i.e., maximum thickness between the surface 122 and the surface 126), so that a user can select a pad 120 of an appropriate thickness to best align the ear pads 112 with the ears 132 of that user. It should be understood that the durability of the present headphone system makes it ideal for use with children, as the headphone portion can be made without moving parts. However, this is not meant to be limiting, as the system 100 can be sized for use by people of any age. Additionally, it should be understood that the headphones 110 of the system 100 can include electronics and signal wires 116*a*, which enter the headphones 110 at the input 116, to carry a signal to speakers 117 located within the ear pads 112. In one particular embodiment of making the headphones 110, the headband 114 is formed to include an internal channel 119 connecting pockets formed for the speakers in the housings 118. While the headband 114 is held flat, a wire attached to a first speaker is pulled from the housing 118 (which will support ear pad 112*b*), through the channel 119 in the headband 114, through the second housing 118 (which will support the ear pad 112*a*) and joined with a wire 116*a* attached to an identical second speaker 117 located in the second housing 118. Both wires exit the second housing via the input 116 and can be terminated at a plug or connector (not shown) for mating with an electronic device. After the speakers are set into the housings 118 and the wires 116*a* are in place, the headband can be released to return to its desired shape. Ear pads 112*a*, 112*b* are fastened over the speakers 117 set into the first and second housings 118, respectively. In one particular embodiment of the invention, the ear pads 112*a*, 112*b* include a foam portion, which is at least partially enclosed by a leather, eco-leather or other material, contact surface. The ear pads 112*a*, 112*b* may be glued to the housings 118 using an adhesive or may be secured by other means.

Alternately, if desired, the headphones 110 can be noise reducing headphones and the electronics and/or speakers 117 could be omitted. In one particular embodiment of the invention, the headphones are provided with a noise-limiting circuitry to prevent the volume from being amplified above a certain level, for example, above 85 decibels.

The present invention provides a durable headphone system that can be sized to an individual through the use of a removable/insertable headband pad. The headphones are flexible and durable, and, thus, are particularly suited to use by children.

Accordingly, while a preferred embodiment of the present invention is shown and described herein, it will be understood that the invention may be embodied otherwise than as herein specifically illustrated or described, and that within the embodiments certain changes in the detail and construction, as well as the arrangement of the parts, may be made without departing from the principles of the present invention as defined by the appended claims.

We claim:

1. Headphones, comprising:

a flexible body formed entirely of ethylene vinyl acetate (EVA) foam, the body including:

a headband having first and second ends;

a first housing immovably fixed at the first end of said headband;

a second housing immovably fixed at the second end of said headband;

wherein a length of said headband between said first housing and said second housing is fixed;

a first ear pad affixed to said first housing; and a second ear pad affixed to said second housing.

2. The headphones of claim 1, wherein the body is formed as a single unitary piece.

3. A headphones system, comprising:

headphones according to claim 1; and a headband pad removably engageable with an inner surface of said headband.

4. The headphones system of claim 3, wherein the headband pad is additionally formed entirely from a foam material.

5. The headphones system of claim 4, wherein said foam material is an ethylene vinyl acetate (EVA) foam.

6. The headphones of claim 4, wherein said foam material is expanded polypropylene (EPP).

7. Headphones, comprising:

a single piece mono-body formed entirely of ethylene vinyl acetate (EVA) foam, the mono-body including:

a headband having first and second ends;

a first housing immovably fixed at the first end of said headband;

a second housing immovably fixed at the second end of said headband;

wherein a length of said headband between said first housing and said second housing is fixed; and said EVA foam being sufficiently flexible to permit stretching out of the mono-body, bending of the mono-body and/or twisting of the mono-body without breaking, and having sufficient shape memory to return the mono-body to the original shape once released.

8. The headphones of claim 7, further comprising:

a first ear pad affixed to said mono-body at said first housing; and a second ear pad affixed to said mono-body at said second housing.

* * * * *